US005123212A

United States Patent [19]

Dallaire et al.

[11] Patent Number: 5,123,212

[45] Date of Patent: Jun. 23, 1992

[54] DRAINAGE SYSTEM AND METHOD OF DRAINING EXTRUDED WINDOW FRAME SILLS

[75] Inventors: Raymond Dallaire; Dominique Dallaire, both of St. David, Canada

[73] Assignee: Dallaire Industries Ltd., Levis-Lauzon, Canada

[21] Appl. No.: 661,549

[22] Filed: Feb. 26, 1991

[51] Int. Cl.[5] ..... E06B 7/14

[52] U.S. Cl. ..... 58/209; 52/235; 52/303; 49/408; 49/471

[58] Field of Search ..... 52/209, 302, 303, 235; 49/408, 471

[56] References Cited

U.S. PATENT DOCUMENTS

| | | | |
|---|---|---|---|
| 3,466,819 | 9/1969 | Giger | 52/209 |
| 3,503,169 | 3/1970 | Johnson et al. | 52/209 |
| 4,003,171 | 1/1977 | Mitchell | 52/209 |
| 4,156,988 | 6/1979 | Grover et al. . | |
| 4,691,487 | 9/1987 | Kessler | 52/209 |
| 4,819,405 | 4/1989 | Jackson | 52/209 |
| 5,044,121 | 9/1991 | Harbom et al. | 52/209 |

FOREIGN PATENT DOCUMENTS

| | | | |
|---|---|---|---|
| 996820 | 9/1976 | Canada . | |
| 1684084 | 11/1969 | Fed. Rep. of Germany | 52/209 |
| 2240341 | 3/1975 | France . | |
| 2250888 | 6/1975 | France . | |
| 2288211 | 5/1976 | France . | |
| 2336860 | 7/1977 | France . | |
| 799964 | 8/1958 | United Kingdom | 52/209 |
| 1537347 | 12/1978 | United Kingdom . | |
| 2022179 | 12/1979 | United Kingdom . | |

*Primary Examiner*—Renee S. Luebke
*Assistant Examiner*—Michael J. Milano
*Attorney, Agent, or Firm*—James D. Hall

[57] ABSTRACT

A drainage system and method of draining extruded window sill frames is disclosed. The drainage system includes a drain cap which provides two separate drain paths for the sill. The drain cap is installed in a drainage orifice in the bottom edge of the outer sill face. The drain cap includes a ramp portion for directing water draining from the front of the sill through one of the drain paths, water from the rear of the sill being permitted to drain through the other drain path. The drain cap is installed using a method whereby a drainage path is formed through any longitudinal portions in the sill which are intermediate the drainage orifice in the bottom of the outer sill face and drain apertures in the sill surface. The drainage path is preferably formed using a horizontal drilling machine equipped with a drill bit having at least two drill diameters for piercing two concentric holes in a single pass. Alternatively, two or more bits are used for drilling two or more holes which are acentric but coextensive.

10 Claims, 6 Drawing Sheets

WATER TESTS - HORIZONTALLY SLIDING WINDOWS

| | | | WITH INSECT SCREEN | | WITHOUT INSECT SCREEN | |
|---|---|---|---|---|---|---|
| | | | IMPROVED DRAINAGE SYSTEM | STANDARD DRAINAGE SYSTEM | IMPROVED DRAINAGE SYSTEM | STANDARD DRAINAGE SYSTEM |
| WINDOW #1 | #1 | 150 Pa | B | B | D | E |
| | #2 | 200 Pa | B | C | E | E-1 |
| | #3 | 300 Pa | D | E-1 | - | - |
| WINDOW #2 | #1 | 150 Pa | A | A | B | B-1 |
| | #2 | 200 Pa | B | B | D | C-1 |
| | #3 | 300 Pa | E | E-1 | - | - |
| WINDOW #3 | #1 | 150 Pa | A | B | B | B |
| | #2 | 200 Pa | A | B-1 | C | C |
| | #3 | 300 Pa | C | D-1 | D | E-1 |

DRAINAGE SYSTEM AND METHOD OF DRAINING EXTRUDED WINDOW FRAME SILLS

The present invention relates to extruded window components and, in particular, to a drainage system for extruded window frame sills.

BACKGROUND OF THE INVENTION

The drainage of rain water and condensation from window sills is a long recognized problem in the window industry. The problem is particularly acute, but not confined to, windows sills for accommodating windows of the horizontally and vertically sliding type. In general, all window sills require some form of drainage system and the more complex a sill design, the more difficult it becomes to provide effective drainage at a reasonable cost. There are many prior art patents directed toward a drainage system for window sills which permits an efficient drainage of rain water and/or condensation while inhibiting the infiltration of wind-driven moisture into the interior of a building. Prior art patents known to be directed to this subject matter include:

Canadian Patent 996,820 - Paull
U.S. Pat. No. 4,003,171 - Mitchell
U.S. Pat. No. 4,156,998 - Grover et al.
British Patent 1,537,347 - Clive Investments Pcy
British Patent Application 2,022,179 - Braithwaite
French Patent 2,288,211 - Monteau
French Patent 2,240,341 - Schinhofen
French Patent 2,250,888 - Monteau
French Patent 2,336,860 - Schurmann The above listed prior art patents describe a variety of drainage systems for windows and window sills, many of which are suitable for use with extruded type window frame sills. A common problem with these prior art systems is that they are complicated and therefore unreliable or they are difficult to manufacture and therefore not cost effective.

Building standards in many countries of the world have become extremely stringent in prohibiting the intrusion of wind blown rain water or condensation into the interior of a building through window structures. Window drainage systems are generally the most common source for the infiltration of wind-blown water through a window structure. Ideally, a window drainage system permits the ready evacuation of rain water and/or condensation while preventing heavy winds from forcing rain or condensation across the window sill and into the interior of a building.

Designing an effective drainage system is further complicated by modern extrusion profiles, especially plastic extrusion profiles which depend on design to minimize the use of plastic materials while maximizing the strength of an extruded window frame sill In order to maximize strength, the window frame sill of a modern window in extruded thermoplastic is a multi-chambered extrusion which complicates the problem of providing proper drainage.

SUMMARY OF THE INVENTION

It is an object of the present invention to provide a drainage system for extruded window frame sills which is economical and easy to install.

It is a further object of the present invention to provide a drainage system for extruded window frame sills which permits windows constructed with those sills to comply with stringent regulations regarding the infiltration of wind-blown water past a window closure.

In accordance with the present invention, there is provided a drainage system for extruded window sills which includes a drainage bore that pierces the outer face of the sill and any partitions within the sill required for providing a drain path from drain aperatures in the sill surface to the drainage bore in the face of the sill. There is further provided a drain cap which is inserted into the drainage bore formed in the face of the sill. The drain cap conceals the drainage bore in the face of the sill and defines two discrete drain paths at the bottom of the drainage bore. The drain cap also includes a ramp for directing water entering the front portion of the sill through one of the drain paths, while water entering the rear portion of the sill is evacuated through the other drain path. By channeling water from each respective region of the sill through a separate drain path, the wind pressure on water draining through each path is reduced and water draining from one path is not mixed with water draining through the other path so that the likelihood of water infiltration across the sill is significantly reduced. The drain cap in accordance with the invention is provided with resilient locking tabs on its opposite sides so that it may be readily inserted into the drainage bore in the face of the sill and locks automatically into position on insertion.

In more specific terms, and in accordance with a first aspect of the invention there is provided:

a drain cap for extruded window sills having an outer sill face, an inner sill face a bottom wall and a sill surface for mating engagement with at least one window pane, the sill surface including at least two laterally spaced drain apertures to permit the passage of water into hollow portions of the sill to provide drainage for the sill surface, at least one said aperture being nearer a top edge of the outer sill face than the other aperture, and at least one drainage bore in the outer sill face adjacent the bottom wall to permit water to drain from the hollow portions of the sill, said drain cap comprising:

a cover portion for concealing the drainage bore in the outer sill face, the cover portion including a front wall having a front surface, a rear surface and a perimeter which is shaped to contact the outer sill face around a top and sides of that bore in that sill face and shaped to provide a drain at a bottom of the cover portion; an inclined ramp portion affixed to the rear surface of the cover portion for evacuating water draining into the sill from the drain aperature in the sill surface nearest the outer sill face through the drain at the bottom of the cover portion; the cover portion and the ramp portion defining, in combination, two segregated drain paths in the drain at the bottom of the cover portion, an outer drain path for evacuating water directed by the ramp portion and an inner drain path for evacuating water entering hollow portions of the sill via the drain aperature laterally spaced from the aperature nearest to the outer sill face; and means for securing the drain cap in the drainage bore in the outer sill face.

In accordance with another aspect of the invention, there is provided a drainage system for extruded window sill frames having an outer sill face, an inner sill face, a bottom wall and a sill surface for mating engagement with at least one window pane, and including at least two longitudinally extending hollow chambers delineated by longitudinally extending partitions within the sill, said system comprising:

at least two laterally spaced apart rows of drain aperatures in the sill surface to permit water to drain from the sill surface into hollow chambers of the window sill, each said row including at least one drain aperature and one said row being located nearer a top edge of the outer sill face than the other row;

at least one drainage bore of at least one diameter which pierces the outer sill face adjacent the bottom wall and any intermediate partitions within the sill required for providing a drain path to the outer sill face from the respective rows of drain aperatures in the sill surface; and a drain cap adapted for engagement in the drainage bore in the sill face, the drain cap including a cover portion for concealing the drainage bore, a rear surface and a perimeter which is shaped to contact the outer sill face around a top and sides of the drainage bore and to provide a drain at a bottom of the drainage bore; an inclined ramp portion affixed to the rear of the cover portion for directing water draining into the sill from the drain apertures in the sill surface adjacent the outer sill face through the drain at the bottom of the drainage bore; the cover portion and the ramp portion defining, in combination, two segregated drain paths in the drain at the bottom of the drainage bore, an outer drain path for evacuating water directed by the ramp portion and an inner drain path for evacuating water entering the sill through the row of drain aperatures remote from the face of the sill; and, means for securing the drain cap in the drainage bore in the outer sill face.

In accordance with yet a further aspect of the invention, there is provided a method of preparing a water drainage system for an extruded window sill having an outer sill face, an inner sill face a bottom wall, a sill surface for mating engagement with at least one window pane, and at least two longitudinally extending hollow chambers delineated by longitudinally extending partitions within the sill, comprising:

forming at least two longitudinal rows of drain aperatures in the sill surface to permit water on the sill surface to drain into the hollow chambers within the sill; each said row including at least one drain aperature and one row being located nearer a top edge of the outer sill face than the other row;

forming at least one drainage bore of at least one diameter, which bore pierces the outer sill face adjacent the bottom wall and any partitions within the sill which are intermediate the outer sill face and the rows of drain apertures in the sill surface to provide a transverse drainage path through the sill, and;

installing in the drainage bore in the outer sill face a drain cap for concealing the drainage bore and providing a drain at a lower edge thereof, the drain cap defining first and second discrete drain paths for evacuating water from the sill, the cap being constructed so that at least the water entering the sill from the row of drain apertures located nearest the outer sill face is evacuated through the first drain path and the water from the other row is evacuated through the second drain path, the drain cap including means for directing water through the first drain path.

BRIEF DESCRIPTION OF THE DRAWINGS

The present invention will now be described by way of example only and with reference to the following drawings wherein.

DETAILED DESCRIPTION OF THE PREFERRED EMBODIMENTS

Figure 1:
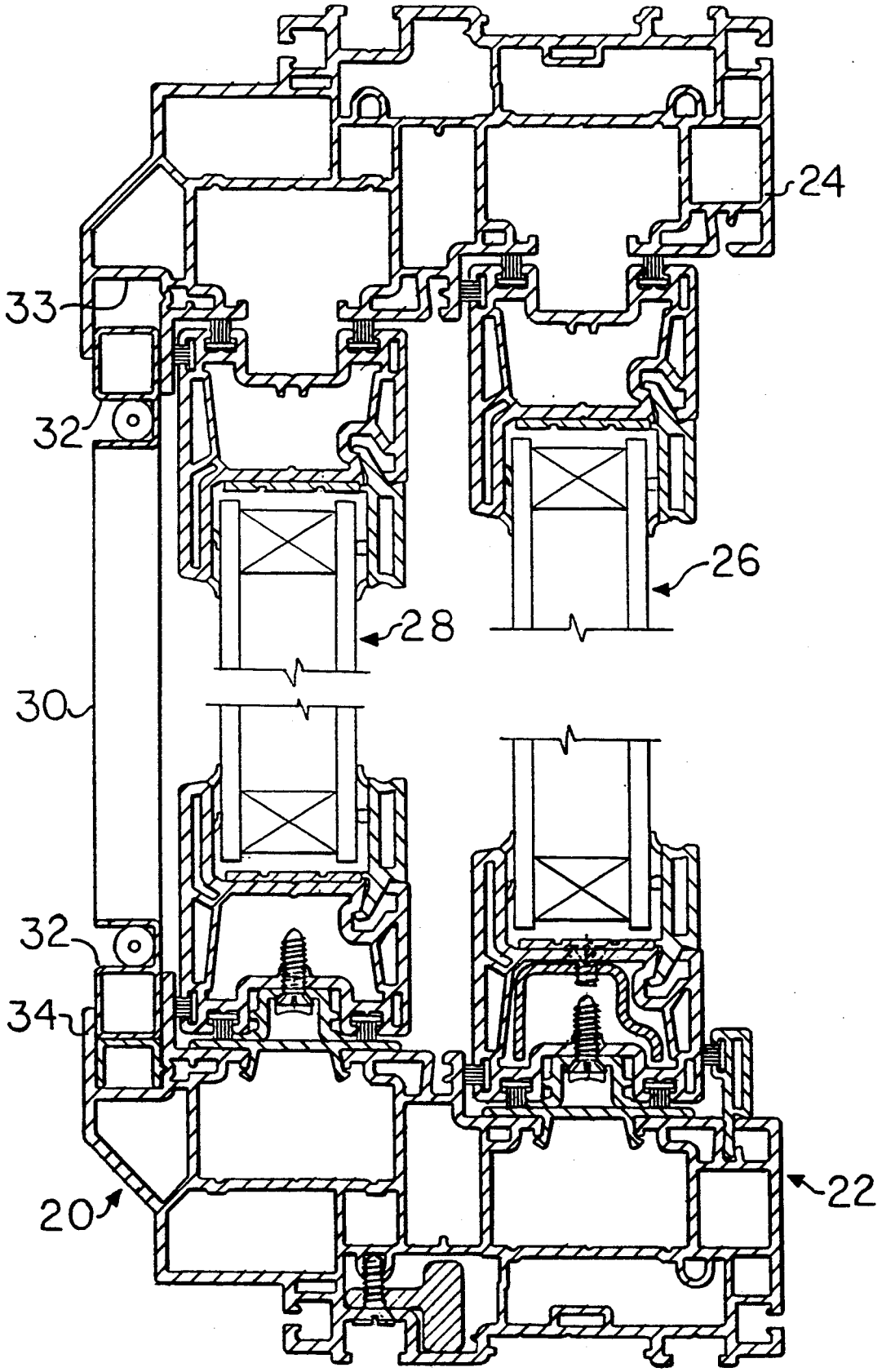
FIG. 1 is a vertical cross-sectional view of a modern horizontally sliding window structure constructed with an extruded window frame.

FIG. 1 shows a vertical cross-sectional view of a modern horizontally sliding window construction, generally referred to by the reference 20, the window construction includes a window frame sill, generally referred to by reference 22, a window frame header 24, an inner window pane 26 and an outer window pane 28. Modern windows frequently further include a window screen 30 to prevent the migration of insects and wind-blown debris through the open window. The window screen 30 is supported by a window screen frame 32 which is commonly held in position by a window screen frame 33 extruded as an integral part of the window frame.

Most window frame sills require drainage to prevent rain water and/or condensation from entering the interior of a building through the window opening. As will be readily appreciated by those skilled in the art, the popular window construction shown in FIG. 1 creates special problems in terms of providing adequate drainage for the window sill. The present invention provides an apparatus and a method for draining rain water and condensation from multi-chambered extruded window frame sills which may be used in the construction of many different windows assemblies, including horizontally sliding, vertically sliding and other window constructions.

Figure 2:
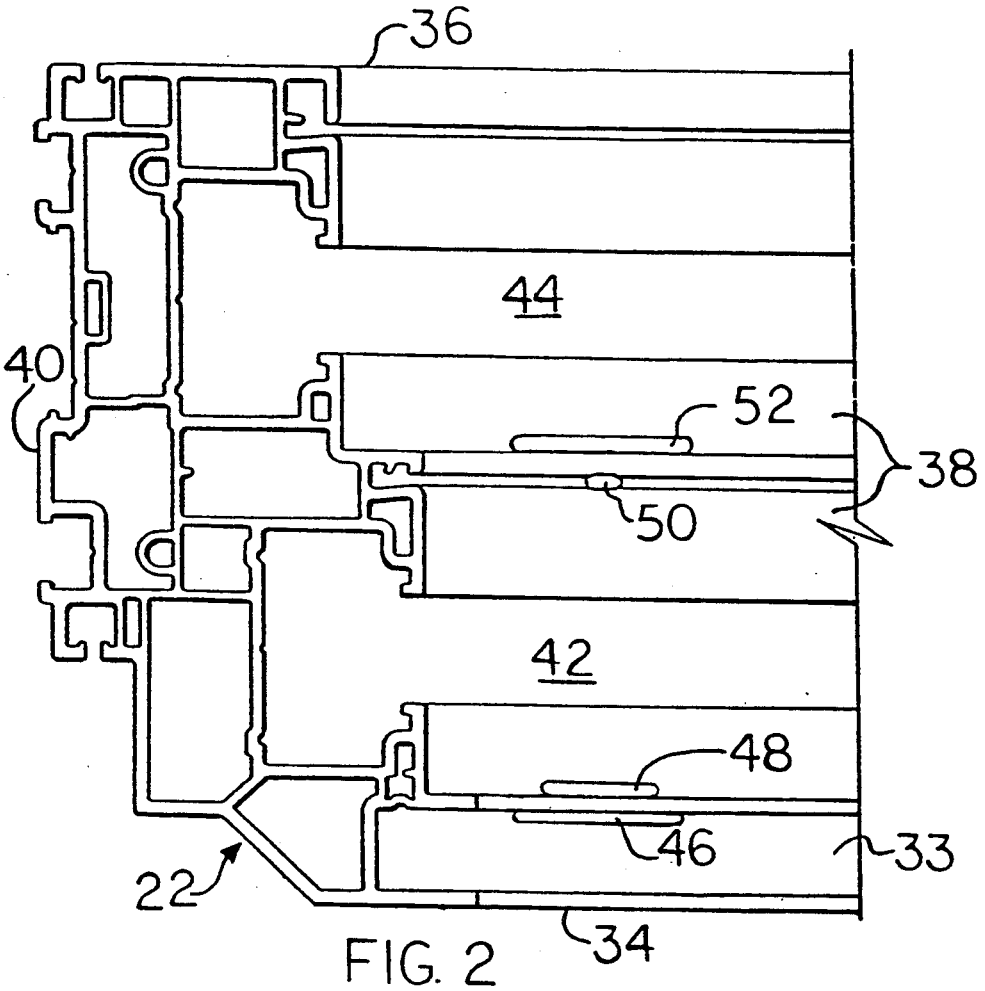
FIG. 2 is an isometric view of one end and a portion of the sill surface of the window frame sill shown in FIG. 1, illustrating a typical pattern for the distribution of drainage orifices in the sill surface.

FIG. 2 is an isometric view of one end and a portion of the top surface of the window frame sill 22, the window frame sill 22 includes an outer sill face 34 an inner sill face 36, a sill surface 38 which extends between the top corners of the outer sill face 34 and the inner sill face 36, and a bottom wall 40. The sill surface 38 includes two sill tracks 42 and 44. In this particular embodiment of a sill, the tracks 42 and 44 are parallel sided gaps which accommodate a variety of different track attachments to accommodate different styles of horizontally and/or vertically sliding window panes. The sill surface 38 may likewise be a continuous solid wall similar in construction to bottom wall 40.

The sill surface 38 must be provided with drain apertures to prevent accumulation of rain water or condensation on the sill. FIG. 2 shows a typical drainage configuration for a sill of this type. This particular drainage configuration includes a window screen frame drain aperture 46 in the sill surface of the window screen frame 33, an outer sill track drain aperture 48 and two inner sill track drain apertures 50 and 52 respectively. This drain aperture pattern is commonly repeated at least two or more times, as required according to window sizes, along the length of the sill. As is apparent these drain apertures in the window sill surface 38 permit water to enter the hollow chambers of the multi-chambered window frame sill extrusion. An evacuation path must therefore be provided in order to permit water entering the window sill frame to drain to the exterior of the sill.

Figure 3:
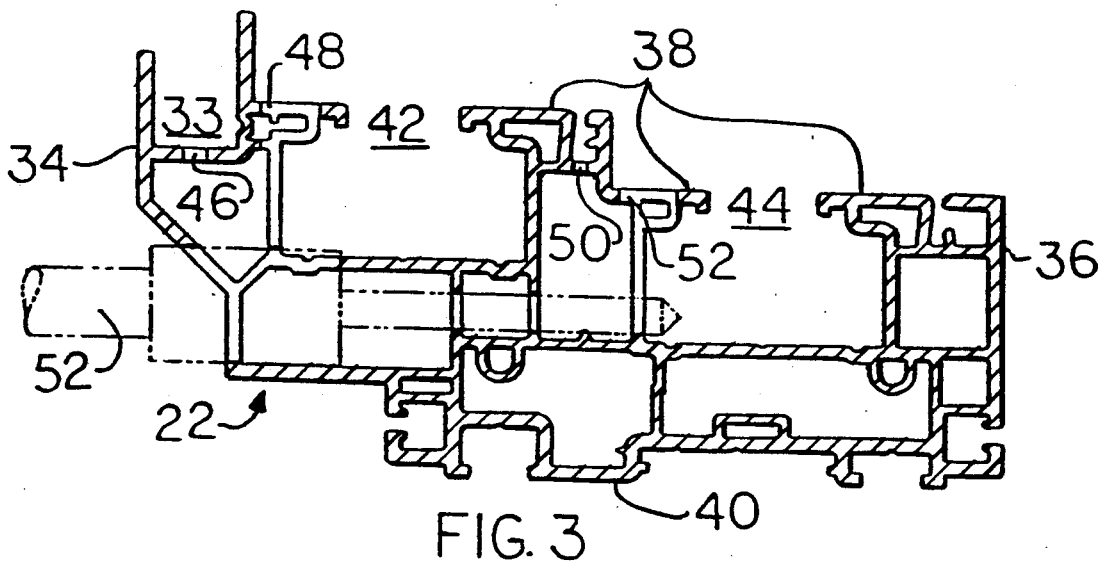
FIG. 3 is a cross-section of a window frame sill and schematically illustrates the position of a dual-diameter drill for forming a drainage bore in the sill.

FIG. 3 illustrates one method of providing a drainage path through the chambers of the window sill frame 22 into which water drains from the sill surface. Due to the particular configuration of this window sill extrusion, a single dual-diameter drill bit 52 may be used to pierce a drainage pathway through the partitions in the window sill extrusion. The drilling operation is conveniently and most accurately performed on drilling machines, various models being well known in the art. A dual-diameter drill bit 52, also well known in the art, pierces a hole in the outer sill face 34. The first or smaller diameter of drill bit 52 is sized to cut a bore through the partitions into the chamber under the inner sill track 44. The second or larger diameter of the drill bit 52 is sized to pierce the chamber under the window screen frame 33 and the bottom wall of the chamber under the outer sill track 42. It is readily understood that several such bores may be spaced along the length of a window sill. The bores are often positioned to coincide with each drain aperture pattern in the sill surface 38, because this permits the fastest machining of the parts. It is actually preferable, however, to stagger the drainage bores with respect to each drain aperture pattern in the sill surface because this tends to prevent strong winds from blowing straight through a sill. Nonetheless, the effectiveness of the invention is not dependent on the position of the drainage bores and either spacing may be used.

Figure 4:
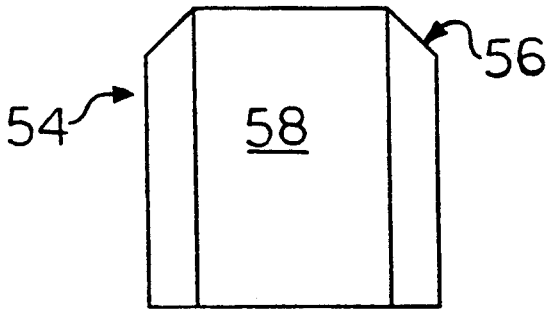
FIG. 4 is a front elevational view of a drain cap in accordance with the invention.
Figure 5:
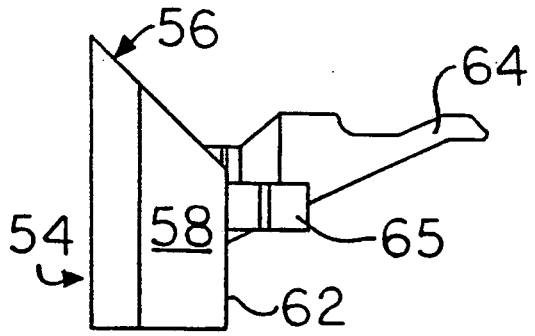
FIG. 5 is a side elevational view of a drain cap shown in FIG. 1.
Figure 6:
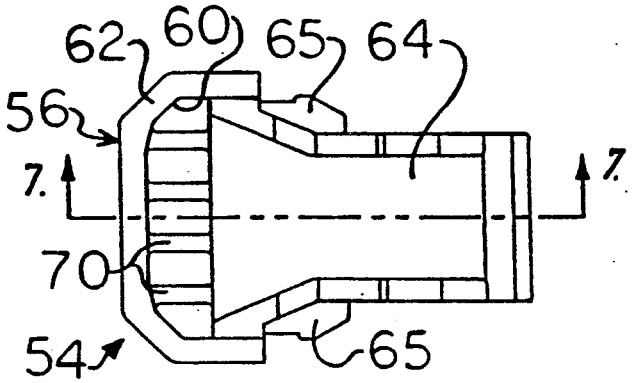
FIG. 6 is a top plan view of the drain cap shown in FIG. 1.
Figure 7:
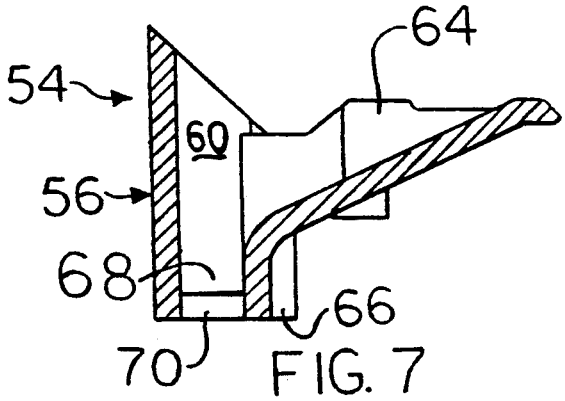
FIG. 7 is a cross-sectional view taken along lines A—A of the drain cap shown in FIG. 6.

Traditionally, a drainage orifice of the type provided by the drainage bore in the sill face 34 is concealed with a drain cap which may include a mesh or screen for preventing insects and other debris from entering the window sill. Extensive experimentation has shown, however, that windows equipped with a standard drainage cap cannot always meet building code specifications which include stringent regulations governing the infiltration of wind-blown water through window closures In order to obviate this problem, a novel drain cap has been invented. This drain cap is illustrated in FIGS. 4 through 7, wherein FIG. 4 is a front elevational view of a preferred embodiment of the drain cap, FIG. 5 is a side elevational view of the preferred embodiment, FIG. 6 is a top plan view and FIG. 7 is a vertical cross-section taken along lines A—A of FIG. 6. The drain cap is generally referred to by reference 54. It includes a cover portion 56 having an outer surface 58, an inner surface 60 (See FIG. 7) and a perimeter 62 (See FIG. 6). The drain cap further includes a ramp portion 64 (See FIGS. 5, 6 and 7) the function of which will be described hereinafter in more detail. As may be seen in FIG. 7, the ramp portion 64 of the drain cap is substantially L-shaped in a midline cross-section. It is attached on its opposite sides to the inner surface 60 of a cover portion 56 (See FIG. 6). The side edges of the cover portion 56 extend rearward of the bottom leg of L-shaped ramp portion 64 to provide two independent drain paths for the window sill when the drain cap is installed in the drainage bore in the outer sill face 34, as will be explained in reference to FIG. 9. Thus, as shown in cross-section in FIG. 7, a drain cap in accordance with the invention provides an inner drain path 66 and an outer drain path 68 Drain path 66 evacuates water from the inner sill track 44 while the outer drain path 68 evacuates water from the outer sill track 42 and the window screen frame 33. The outer drain path 68 is also protected, because of its width, by a grid or mesh 70 to prevent insects and other wind blown debris from entering the window sill through that outer drain path 68.

In order to facilitate and simplify installation of the drain cap 54 in a drainage bore in an outer face of a window frame sill, the drain cap is provided with resilient locking tabs 65 (See FIG. 6) affixed to the opposite side edges of the inner surface 60 of the drain cap. The locking tabs 65 have tapered ends to facilitate their entry into a bore and rectangular slots which engage the opposed sides of the bore when the drain cap is pressed into the bore The locking tabs 65 automatically lock the drain cap 54 in a properly sized bore when the drain cap is pressed into the bore.

Figure 8:
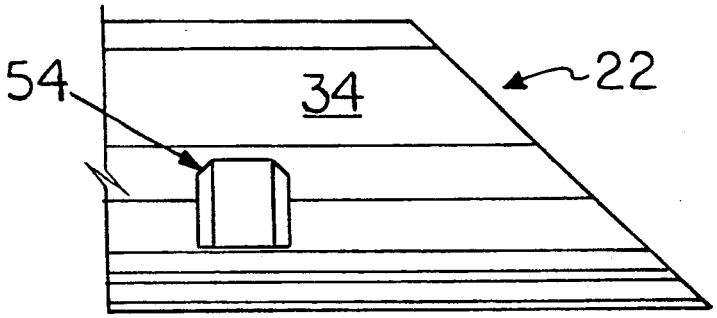
FIG. 8 is an elevational view of a section of an extruded window frame sill showing the miter-cut corner of the sill and a drain cap in accordance with the invention installed in the sill.

FIG. 8 shows a portion of a window frame sill 22 having a miter cut on its right end and a drain cap 54 installed adjacent its right end. It is preferable that all drain apertures are cut in the sill surface 38 and all drainage bores are formed in the outer sill face 34 before the window frame sill 22 is welded to jambs to construct a window frame.

Figure 9:
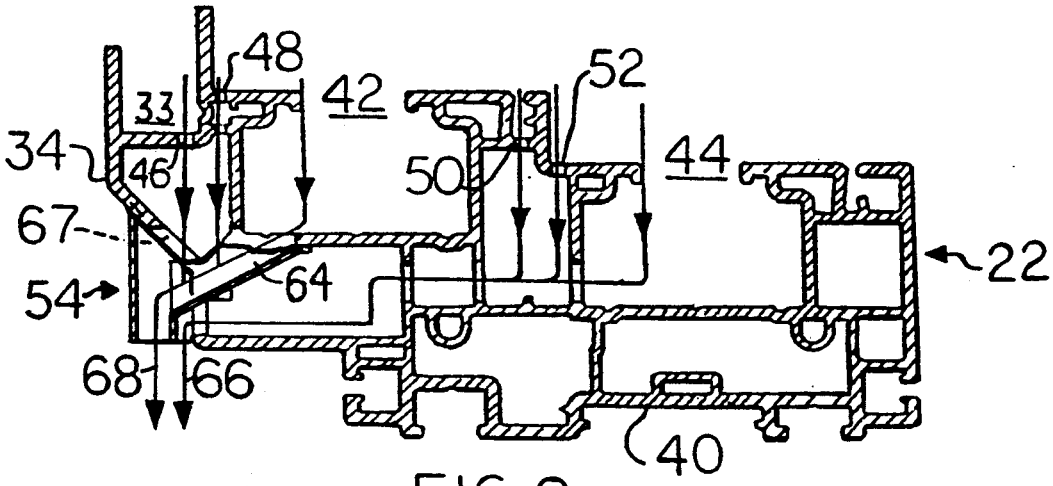
FIG. 9 is a cross-sectional view of the window frame sill shown in FIG. 3, with a drain cap in accordance with the invention installed in the drainage bore, the flow paths for water draining from the sill surface being schematically illustrated.

FIG. 9 is a cross-sectional view of the window frame sill 22 shown in FIG. 3 with a drain cap in accordance with the invention installed in a drainage bore 67 in the outer sill face 34. FIG. 9 also schematically illustrates the flow path of rain water and condensation which drains into the hollow chambers of the window sill 22. As is apparent, water draining through drain apertures 46 and 48, located in the window screen frame 33 and the outer sill track 42 respectively, drains through the large diameter drainage bore 67 in the outer sill face and the bottom walls of the chambers beneath the window screen frame 33 and the outer sill track 42. Therefore, all water draining through the sill surface adjacent to the outer sill face 34 is directed by the ramp portion 64 of the drain cap 54 through the outer drain path 68. On the other hand, water draining through drain apertures 50 and 52 and the inner sill track 44 flows through the small diameter drainage bores in the intervening partitions and out through the inner drain path 66. Likewise, air pressure exerted by wind on the window structure is split by the inner drain path 66 and the outer drain path 68. This drain arrangement provides the beneficial effect of splitting the water flow from each region of the sill so that there is no inter-mixing of water draining through the front of the sill with water draining through the inner portion of the sill surface. Segregating the drain paths in this fashion helps prevent strong wind gusts from forcing large quantities of water into the inner sill and, consequently, into the interior of the building. Splitting the drainage orifice into two independent paths also reduces the air pressure inside the sill by reducing the aperture for entry of the wind. The effects of this draining system, as determined by experimentation, shall be explained in more detail in reference to FIG. 12.

Figure 10:
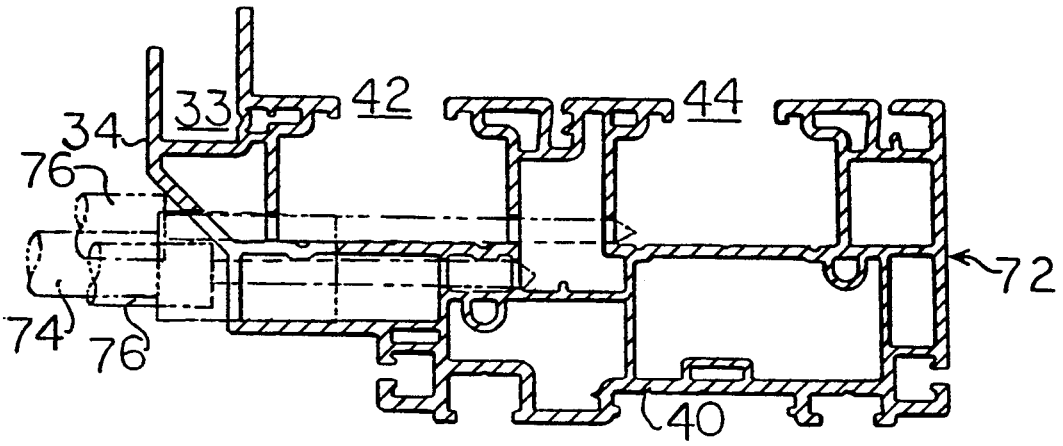
FIG. 10 is a cross-sectional view of another extruded frame construction showing the position of drills used for making drainage bores in the window sill frame.

FIG. 10 shows an alternate modern window frame sill, generally indicated by reference 72. This window frame sill is similar to the one shown in FIG. 2 and FIG. 9 with the exception that the inner sill track 44 and the outer sill track 42 lie in the common plane. Drain apertures for the sill surface are preferably cut in the same pattern as that illustrated in FIG. 2. It should be appreciated that many alternate patterns may be used with equal success. Providing a horizontal drain path for this particular sill is more complicated and less readily achieved than for the sill illustrated in FIG. 3. Nonetheless, using a boring machine, a drain path is readily formed with three boring operations. A first square shouldered bit 74 is used to cut a large diameter hole through the outer sill face 34 of the window frame sill 72. A smaller diameter bit 76 is then used to drill two drainage bores, one just above and one just beneath the bottom wall of the chamber beneath the outer sill track 42. These two drilling operations provide a drain path for water entering the sill surface from the inner sill track 44. As may be seen in FIG. 11, water entering the sill adjacent the outer sill face 34 is directed by the ramp portion 64 of the drain cap 54 through the outer drain path 68, while water entering the sill in the region of the inner sill track 44 is evacuated through the inner drain path 66 provided by drain cap 54, ensuring the beneficial effects described above.

Although the invention hereinbefore described has been described with reference to only two window frame sill constructions, it will be readily appreciated by those skilled in the art that the teachings of the invention may be readily adapted for use with practically any multiple chambered extruded window frame sill construction.

Figure 12:
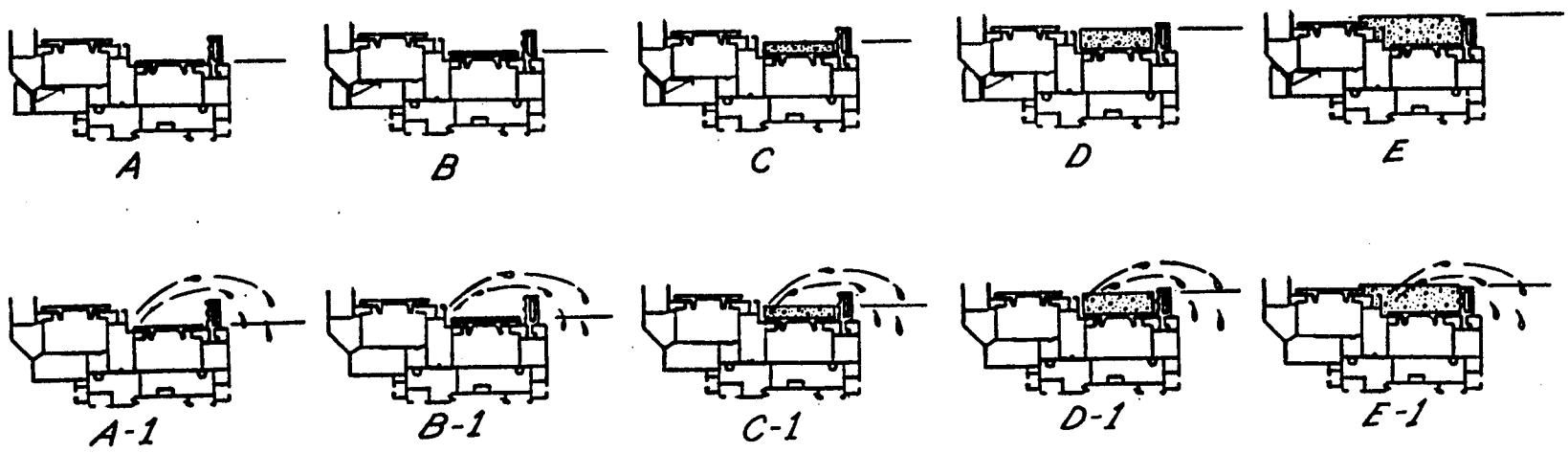
FIG. 12 is a table showing comparative tests results of horizontally sliding windows provided with a drainage system in accordance with the invention and identical horizontally sliding windows provided with conventional drain caps.

As shown in FIG. 12, water tightness tests performed on horizontally sliding windows prove the efficacy of the teachings of the invention. Tests were conducted using horizontally sliding windows because they are the window construction which is most susceptible to the infiltration of wind-blown water. All tests were conducted using window sills of the type shown in FIGS. 3 and 9, since that particular sill design is among the most difficult to drain in accordance with building codes. The window sills were subjected to controlled laboratory tests in accordance with international testing standards, namely the Canadian Standards Association (CSA-440 National Windows Standard) which stipulates in s.11.3.2 that:

> The test shall be conducted in accordance with ASTM [American Standard For testing Materials] Standard E547 at the test pressure selected from Table 2 [of that standard].

In accordance with those standards, 34 L/m$^2$.min (5.0 U.S Gal./f$^2$.h) were sprayed against the window while a pressure differential across the window of 150 to 300 Pa was applied in four cycles, each cycle consisting of 5 minutes with pressure applied and 1 minute with pressure released, during which time the water spray was continuously applied, in accordance with the standard. In addition the windows were tested with insect screen and without insect screen.

Figure 11:
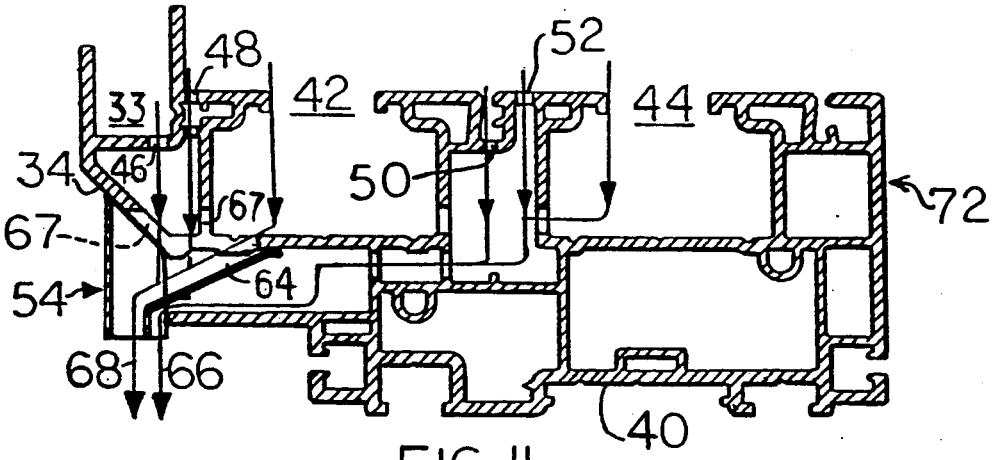
FIG. 11 is a cross-sectional view of the window sill frame shown in FIG. 7, with a drain cap in accordance with the invention installed in the drainage bore.

As is apparent from FIG. 11, in general windows equipped with insect screen performed better in water tightness tests because the insect screen diverts water from the sill and also probably reduces water pressure and/or wind pressure on the drain apertures in the sill surface. As is shown in FIG. 12, three windows were tested. Each window differed only in the number of drain apertures in the sill surface. Columns 1 and 2 list the comparative results of windows equipped with insect screen Column 1 shows windows equipped with the improved drainage system in accordance with the invention while Column 2 shows the results for windows with a standard, prior art drainage system. Columns 3 and 4 show the results of windows tested without insect screen. Column 3 shows the results for windows equipped with the improved drainage system in accordance with the invention while Column 4 shows windows equipped with a standard, prior art drainage system.

The drawings of window cross-sections under the Table in FIG 12 show the actual water level in the inner sill track of windows during the respective tests. In illustrations A through E, even though the water level in the inner sill track may have been significant, no water migrated across the sill and windows with ratings A through E passed the water intrusion test. Illustrations A-1 through E-1 however, show that even though in some circumstances very little water was present in the inner sill track, water was nonetheless blown across the sill and those windows failed the water tightness test. It should be understood that FIGS. A-1 through E-1 are illustrative only and do not attempt to show the actual migration of water across the sill. In reference again to the Table, it is apparent that of windows equipped with insect screen, each window equipped with the improved drainage system in accordance with the invention passed the water infiltration tests. The windows equipped with window screen and a standard drainage system, however, failed the test at higher wind pressures. For instance, Window #1 equipped with insect screen and a standard drainage system failed the test at 300 Pa of pressure (and above). Window #2 equipped with insect screen and a standard drainage system also failed the water tightness test at 300 Pa. Window #3 equipped in the same way failed the test at both 200 and 300 Pa.

The drainage system of windows without insect screens are subjected to more water and therefore the windows are less prone to exclude water at high pressures. As is apparent from columns 3 and 4 of the Table in FIG. 12, the improved drainage system in accordance with the invention maintained a lower water level in the inner sill track than the standard drainage system maintained. Neither system, however, was able to pass the test at 300 Pa of pressure. In Window #2, both tests were successful with the improved drainage system in accordance with the invention while both tests were unsuccessful in the window equipped with the standard drainage system. In tests performed on Window #3, all three tests were successful in the window equipped with the improved drainage system in accordance with the invention. The standard drainage system failed the test, however, at 300 Pa.

It is apparent from the above that the improved drainage system in accordance with the invention enhances the evacuation of wind driven water from extruded window sills.

Various changes and modifications to the embodiments hereinbefore described may be made without departing from the scope of the invention which is intended to be limited solely by the scope of the appended claims.

The embodiments of the invention in which an exclusive property or privilege is claimed are as follows:

1. A drain cap for extruded window sills having an outer sill face, an inner sill face, a bottom wall and a sill surface for mating engagement with at least one window pane, the sill surface including at least two laterally spaced drain apertures to permit the passage of water into hollow portions of the sill to provide drainage for the sill surface, at least one said aperture being nearer a top edge of the outer sill face than the other aperture, and at least one drainage bore in the outer sill face adjacent to the bottom wall to permit water to drain from the hollow portions of the sill, said drain cap comprising:

a cover portion for concealing the drainage bore in the outer sill face, the cover portion including a front wall having a front surface, a rear surface and a perimeter which is shaped to contact the outer sill face around a top and sides of that bore in that sill face, and shaped to provide a drain at a bottom of the cover portion;

an inclined ramp portion affixed to the rear surface of the cover portion for directing water draining into the sill from the drain aperture in the sill surface nearest the outer sill face through the drain at the bottom of the cover portion;

the cover portion and the ramp portion defining, in combination, two segregated drain paths in the drain at the bottom of the cover portion, an outer drain path for evacuating water directed by the ramp portion and an inner drain path for evacuating water entering the hollow portion of the sill via the drain aperture laterally spaced from the aperture nearest the outer sill face; and means for securing the drain cap in the drainage bore in the outer sill face.

2. A drainage system for extruded window sill frames having an outer sill face, an inner sill face, a bottom wall and a sill surface for mating engagement with at least one window pane, and including at least two longitudinally extending hollow chambers delineated by longitudinally extending partitions within the sill, said system comprising:

at least two laterally spaced apart rows of drain apertures in the sill surface to permit water to drain from the sill surface into hollow chambers of the window sill, each said row including at least one drain aperture and one said row being located nearer a top edge of the outer sill face than the other row;

at least one drainage bore of at least one diameter which pierces the outer sill face adjacent the bottom wall and any intermediate partitions within the sill required to provide a drain path to the outer sill face from the respective rows of drainage apertures in the sill surface; and a drain cap adapted for engagement in the drainage bore in the sill face, the drain cap including a cover portion for concealing the drainage bore, a rear surface and a perimeter which is shaped to contact the outer sill face around a top and sides of the drainage bore and to provide a drain at a bottom of the drainage bore; an inclined ramp portion affixed to the rear of the cover portion for directing water draining into the sill from the drain apertures in the sill surface adjacent the outer sill face through the drain at the bottom of the drainage bore; the cover portion and the ramp portion defining, in combination, two segregated drain paths in the drain at the bottom of the drainage bore, an outer drain path for evacuating water directed by the ramp portion and an inner drain path for evacuating water entering the sill through the row of drain apertures remote from the outer sill face; and, means for securing the drain cap in the drainage bore in the outer sill face.

3. A method of preparing a water drainage system for an extruded window sill having an outer sill face, an inner sill face, a bottom wall, a sill surface for mating engagement with at least one window pane, and at least two longitudinally extending hollow chambers delineated by longitudinally extending partitions within the sill, comprising:

forming at least two longitudinal rows of drain apertures in the sill surface to permit water on the sill surface to drain into the hollow chambers within the sill; each said row including at least one drain aperture and one row being located nearer a top edge of the outer sill face than the other row;

forming at least one drainage bore of at least one diameter, which bore pierces the outer sill face adjacent the bottom wall and any partitions within the sill which are intermediate the sill face and the rows of drain apertures in the sill surface to provide a drainage path through the sill, and;

installing in the drainage bore in the outer sill face a drain cap for concealing the drainage bore and providing a drain at a lower edge thereof, the drain cap providing first and second discrete drain paths for evacuating water from the sill, the cap being constructed so that at least the water entering the sill from the row of drain apertures located nearest the outer sill face is evacuated through the first drain path and the water from the other row is evacuated through the second drain path, and the drain cap including means for directing water through the first drain path.

4. A drain cap for extruded window sills as recited in claim 1 wherein the means for securing the drain cap in the drainage orifice in the outer sill face comprises locking tabs affixed to opposite inner side surfaces of the cover portion of the drain cap, said locking tabs extending rearwardly of the side edges of the cover portion and including tapered ends to facilitate their entry into the drainage bore and rectangular notches adjacent the side edges of the cover portion, so that on pressing the drain cap into the drainage bore, the tabs are laterally deflected until opposed edges of the drainage bore slide into the rectangular notches and the tabs rebound to secure the drain cap in the drainage bore.

5. A drain cap for extruded window sills as recited in claim 2 wherein the means for securing the drain cap in the drainage bore in the outer sill face comprises locking tabs affixed to opposite inner side surfaces of the cover portion of the drain cap, said locking tabs extending rearwardly of the side edges of the cover portion and including tapered ends to facilitate their entry into the drainage bore and rectangular notches adjacent the side edges of the cover portion so that on pressing the drain cap into the drainage bore, the tabs are laterally deflected until opposed edges of the drainage bore slide into the rectangular notches and the tabs rebound to secure the drain cap in the drainage bore.

6. The drain cap for extruded window sills as recited in claims 1 or 2 wherein the ramp portion comprises a thin body which is substantially L-shaped in a midline longitudinal cross-section, the long leg of the L-shaped body having opposed upstanding side edges which form a trough in combination with that leg for directing water draining from the sill, the short leg being in spaced-apart parallel relation with the inner surface of the bottom of the cover portion and providing a partition for segregating the two drain paths.

7. A drain cap as recited in claims 1 or 2 wherein the drain cap further includes a grid or mesh which covers a bottom of either of the inner and outer drain paths.

8. A method as recited in claim 3 wherein the drainage bore is formed with a horizontal boring machine.

9. A method as recited in claim 3 wherein the drainage bore comprises a large bore of a first diameter which pierces the outer sill face and certain longitudinal partitions within the sill and is required to provide a drain path from the row of drain apertures located nearer a top edge of the outer sill face, and a smaller bore of a second diameter which pierces any other longitudinal partitions in the sill required to provide a drain path from the other row of drain apertures, the first and second bores being concentric.

10. A method as recited in claim 3 wherein the drainage bore comprises a large bore of a first diameter, which pierces the outer sill face and certain longitudinal partitions within the sill and is required to provide a drain path from the row of drain apertures located nearer a top edge of the outer sill face, and at least one smaller bore of a second diameter which pierces any other partitions required to provide a drain path from the other row of drain apertures, the smaller bore being disposed within the circumference of the larger bore but not concentric therewith.

* * * * *